US006486417B1

(12) United States Patent
Toyama et al.

(10) Patent No.: US 6,486,417 B1
(45) Date of Patent: Nov. 26, 2002

(54) CIRCUIT BREAKER ON-OFF SWITCH MECHANISM

(75) Inventors: Kentaro Toyama, Kanagawa (JP); Naoshi Uchida, Kanagawa (JP); Tatsunori Takahashi, Kanagawa (JP)

(73) Assignee: Fuji Electric Co., Ltd., Kanagawa (JP)

( * ) Notice: Subject to any disclaimer, the term of this patent is extended or adjusted under 35 U.S.C. 154(b) by 164 days.

(21) Appl. No.: 09/609,686

(22) Filed: Jul. 5, 2000

(30) Foreign Application Priority Data

Jul. 7, 1999 (JP) ..... 11-192712

(51) Int. Cl.[7] ..... H01H 3/00; H01H 9/20

(52) U.S. Cl. ..... 200/17 R; 200/50.01; 200/339; 200/572

(58) Field of Search ..... 200/50.32, 329–339, 200/318.1–327, 17 R, 50.01–50.4, 400, 401, 553–563, 564–572; 335/185–201, 14–21, 16, 147, 161, 162, 171

(56) References Cited

U.S. PATENT DOCUMENTS 4,022,997 A * 5/1977 Inagaki et al. ..... 200/61.45 R
4,618,745 A * 10/1986 Thompson, III ..... 200/50.32
4,713,640 A * 12/1987 Murphy et al. ..... 335/194
4,945,326 A * 7/1990 Kandatsu ..... 335/16
5,861,784 A * 1/1999 Heise et al. ..... 335/20
5,990,434 A * 11/1999 Fujihira et al. ..... 200/401

* cited by examiner

*Primary Examiner*—J. R. Scott
(74) *Attorney, Agent, or Firm*—Pearne & Gordon LLP

(57) ABSTRACT

A circuit breaker mechanism includes an operating part and an on-off switch part. The operating part includes a handle, a shaft, and a mechanism member. The handle is engages the shaft for rotation. The mechanism member moves responsively to rotation of the handle. The on-off switch part includes a switch lever, a switch shaft, and a spring. The switch lever is supported for rotation by the switch shaft between on and off positions. The spring biases the switch lever to one of the positions. The mechanism member has a portion engagable with a portion of the switch lever to control movement of the switch lever. The portions of the mechanism member and the switch lever are configured to permit assembly of the on-off switch part separate from the assembly of the operating part and engagement of the portions of the mechanism member and the switch lever subsequent to assembly of the on-off switch part.

20 Claims, 5 Drawing Sheets

CIRCUIT BREAKER ON-OFF SWITCH MECHANISM

BACKGROUND OF THE INVENTION

1. Field of the Invention

The present invention relates to a circuit breaker for on-off switching and protection of a low-voltage circuit, and more specifically relates to an on-off switch mechanism for on-off switching actions of a movable contact element.

2. Description of the Related Art

The aforenamed on-off switch mechanism usually comprises an operating handle that is operated to rotate with a handle shaft as a fulcrum, an on-off switch lever that is so supported as to rotate freely via anon-off switch shaft and that is applied with some force in one direction by a main spring and a mechanism member for transmission of operation of the operating handle to the on-off switch lever, and has a structure wherein, when the operating handle is operated to rotate to ON side, with some force being accumulated in the main spring, the on-off switch lever is rotated to ON position to connect a movable contact element to close an electric circuit but, when the operating handle is operated to rotate to OFF side, with energy of force accumulated in the main spring, the on-off switch lever is rotated to OFF position to disconnect the movable contact element to open the electric circuit. A series of members from the operating handle to the on-off switch lever are usually engaged inseparably with a shaft that penetrates the members and the while on-off switch mechanism is assembled as a single unit inside the circuit breaker.

As for the on-off switch mechanism, specifications of the main spring are varied by rated current while width of on-off switch lever is varied by dimensions of the casing. Therefore, since the entire on-off switch mechanism of the prior art is inseparably engaged as a single unit, the on-off switch mechanism has been assembled individually in accordance with combination of the rated current and the casing dimensions. The conventional on-off switch mechanism, however, wherein those for the same rated current but of different casing dimensions are separated by types, results with large variety of assembly items and complicated assembly operations and parts control hinders cost reduction.

SUMMARY OF THE INVENTION

An object of the invention is to decrease variety of on-off switch mechanism assembly items and to simplify the assembly operations and parts control while flexibly coping with the combination of the rated current and the casing dimensions.

According to a first aspect of the present invention, there is provided a circuit breaker on-off switch mechanism which comprises: an operating handle that is operated to rotate with a handle shaft as a fulcrum, an on-off switch lever that is so supported as to rotate freely via an on-off switch shaft and that is applied with some force in one direction by a main spring and a mechanism member for transmission of operation of the operating handle to the on-off switch lever, wherein, when the operating handle is operated to rotate to ON side, with some force being accumulated in the main spring, the on-off switch lever is rotated to ON position to connect a movable contact element to close an electric circuit but, when the operating handle is operated to rotate to OFF side, with energy of force accumulated in the main spring, the on-off switch lever is rotated to OFF position to disconnect the movable contact element to open and break the electric circuit;

wherein an operating part that comprises the operating handle and mechanism member and an on-off switch part that comprises the on-off switch shaft, the main spring and the on-off switch lever are constructed as separate units and that the operating part and the on-off switch part are so engaged as to be disengaged and re-engaged freely.

In the on-off switch mechanism in accordance with the first aspect of the invention, since the on-off switch part, which includes the on-off switch lever of a width that is varied by the casing dimensions and the main spring of which specifications are varied by the rated current, and the operating part, which is used in common without relevance to the rated current or casing dimensions, are structured as the separate units that are so engaged as to be disengaged and re-engaged freely to constitute the on-off switch mechanism, various types of on-off switch mechanisms can be formed freely through combination of the common-use operating part and the specification-conforming on-off switch part, and thus there will be no need to prepare a large number of on-off switch mechanisms assembled in advance.

According to a second aspect of the present invention, the simplest way to engage the operating part with the on-off switch part is to dispose the transmission shaft provided on the mechanism member orthogonally against an interlock shaft provided on the on-off switch lever so that the operating part is engaged with the on-off switch part.

According to a third aspect of the present invention, in the on-off switch mechanism according to the second aspect of the invention, with a hook part that is formed by bending a tip of the mechanism member where the transmission shaft is attached to in such manner that this hook part can be engaged with the interlock shaft of on-off switch lever, the hook part can engage with the interlock shaft of the on-off switch lever so that the actions of the operating part can be unified with those of the on-off switch part in a case where rotating of the on-off switch lever is disabled by the movable contact element that is locked by such a cause as fusing of the contact point.

According to a fourth aspect of the present invention, in the on-off switch mechanism according to any of the first through the third aspect of the invention, a pair of on-off switch shafts on the right and left may be fitted onto projections that are provided on both sides of the on-off switch lever so that a larger space will be reserved inside of the on-off switch lever.

According to a fifth aspect of the present invention, it is desirable that a transmission groove for transmission of mechanical signals to outer packaging accessories is provided in a diametric direction on an end surface of the on-off switch shaft.

According to a sixth aspect of the present invention, two or more of the transmission grooves are additionally provided in different directions on a selfsame end surface of the on-off switch shaft.

BRIEF DESCRIPTION OF THE DRAWINGS

FIGS. 5A to 5C show front views drawings to illustrate the actions of the on-off switch mechanism in FIG. 1, wherein FIG. 5A shows the ON state, FIG. 5B shows and OFF state and FIG. 5C shows trip state.

DETAILED DESCRIPTION OF THE PRESENT INVENTION

Figure 5A:
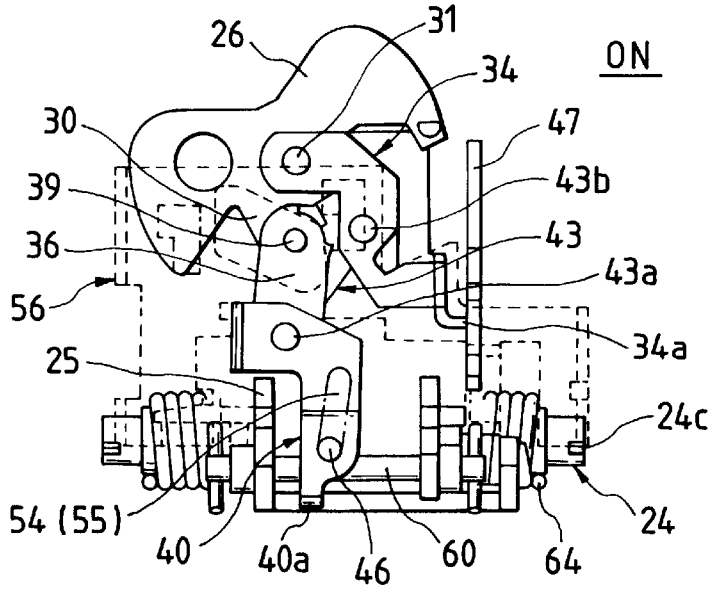
Figure 5B:
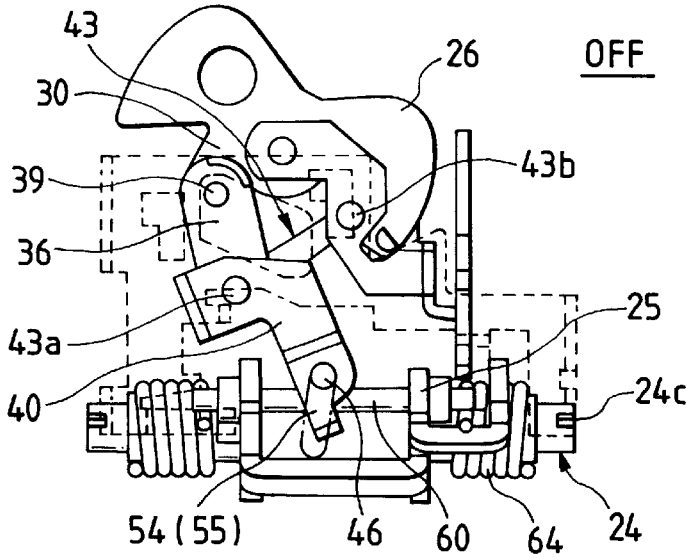
Figure 5C:
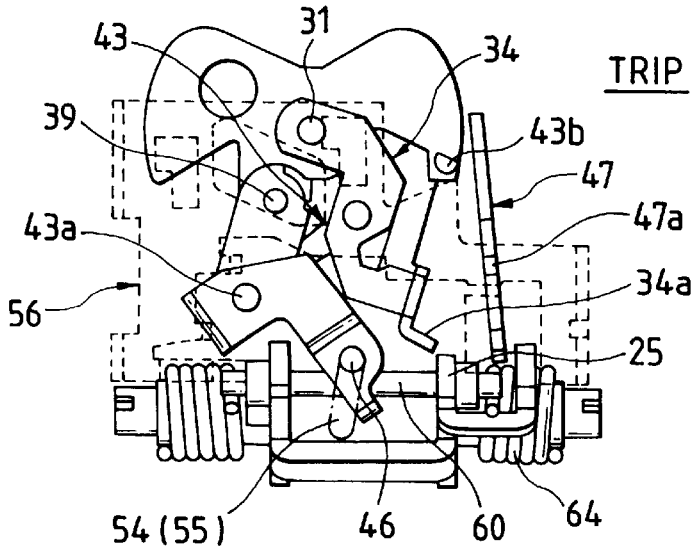
Figure 6:
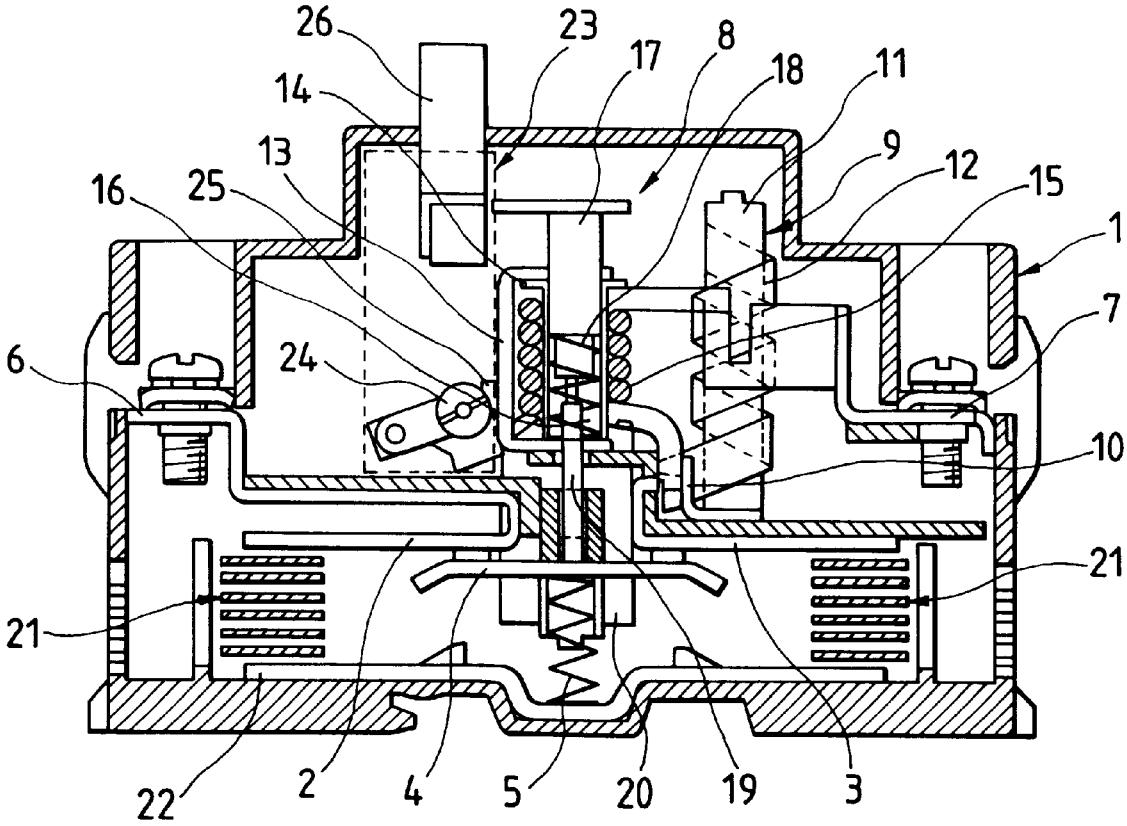
FIG. 6 shows a vertical section of the circuit breaker that comprises the on-off switch mechanism in FIG. 1.

With references to FIGS. 1–6, modes for carrying out the invention are described now. FIG. 6 shows a vertical section of a circuit breaker that comprises an on-off switch mechanism that is related to the invention in the ON state. As shown in FIG. 6, a pair of stationary contact elements 2 and 3 are fastened at a front part and a rear part on a middle stage of a casing 1 with the polarity thereof in parallelism and, against the lower surface thereof, a movable contact element 4 that bridges between those is pressed by a contact spring 5 that comprises a compression coil spring. Stationary contact elements and movable contact elements are respectively connected to the mutual contact points where the stationary contact elements 2 and 3 contact the movable contact element 4.

At the left-hand end of the casing 1 in the picture, a supply-side terminal 6 is so provided as to form a single piece with the stationary contact element 2. At the right-hand end of the casing 1, a load-side terminal 7 is provided, and the terminal 7 is connected to the stationary contact element 3 via an electromagnetic device 8 and an over-load current detection device 9. The over-load current detection device 9 comprises a bimetal 11, which is so supported as to stand upright by a bimetal support 10 that comprises an electrically conductive plate, and a heating conductor 12, which is helically wound around the bimetal 11, and a bottom end of the heating conductor 12 is connected to the stationary contact element 3 while a top end is connected to the bimetal 11.

In the electromagnetic device 8, an electromagnetic coil 15 that is wound around a hollow cylindrical bobbin 14 is disposed inside a U-shaped yoke 13 that is squarely bent along both edges thereof, and a cylindrical plunger 17 is so inserted as to slide freely into a bobbin 14 and to confront a stationary iron core 16 that is so formed as to constitute a single piece with the yoke 13, wherein a reset spring 18, which comprises a compression spring, is mounted between the stationary iron core 16 and the plunger 17, and wherein a rammer 19, which comprises a round rod material, is so provided as to penetrate the stationary iron core 16 and the yoke 13 and to be capable of free vertical movements. The movable contact element 4 is so guided and retained as to be capable of free vertical slides by a holder 20, which comprises insulating material (resin) that is so formed as to involve three poles in one body, and the rammer 19 so penetrates the holder 20 as to slide freely, wherein the tip hits at the upper surface of the movable contact element 4.

Respectively at the front and rear of the movable contact element 4, arc-extinguishing chambers 21 are provided, and a commutation plate 22 that comprises an electrically conductive strip is so disposed as to bridge between the arc-extinguishing chambers 21. The movable contact element 4 is driven to switch on and off and to open and close the circuit by on-off switching actions and tripping actions of the on-off switch mechanism 23. The on-off switch mechanism 23, the inner structure of which is described later, includes an on-off switch lever 25 that rotates with the on-off switch shaft 24 as the center; when the operating handle 26 is operated to rotate to the OFF state from the ON state in the figure, the on-off switch lever 25 is rotated clockwise so that the movable contact element 4 is pressed down against the contact spring 5 via the holder 20 and thus the circuit between the stationary contact elements 2 and 3 are opened. When a latch in the on-off switch mechanism 23, which is not shown in the figure, is unlatched by activation of the electromagnetic device 8 or the overloaded current detection device 9 via a transmission mechanism that is not shown in the figure, the on-off switch lever 25 is driven clockwise by discharge of energy that is accumulated in the main spring, pressing the movable contact element 4 and opening the circuit between the stationary contact elements 2 and 3.

Figure 1:
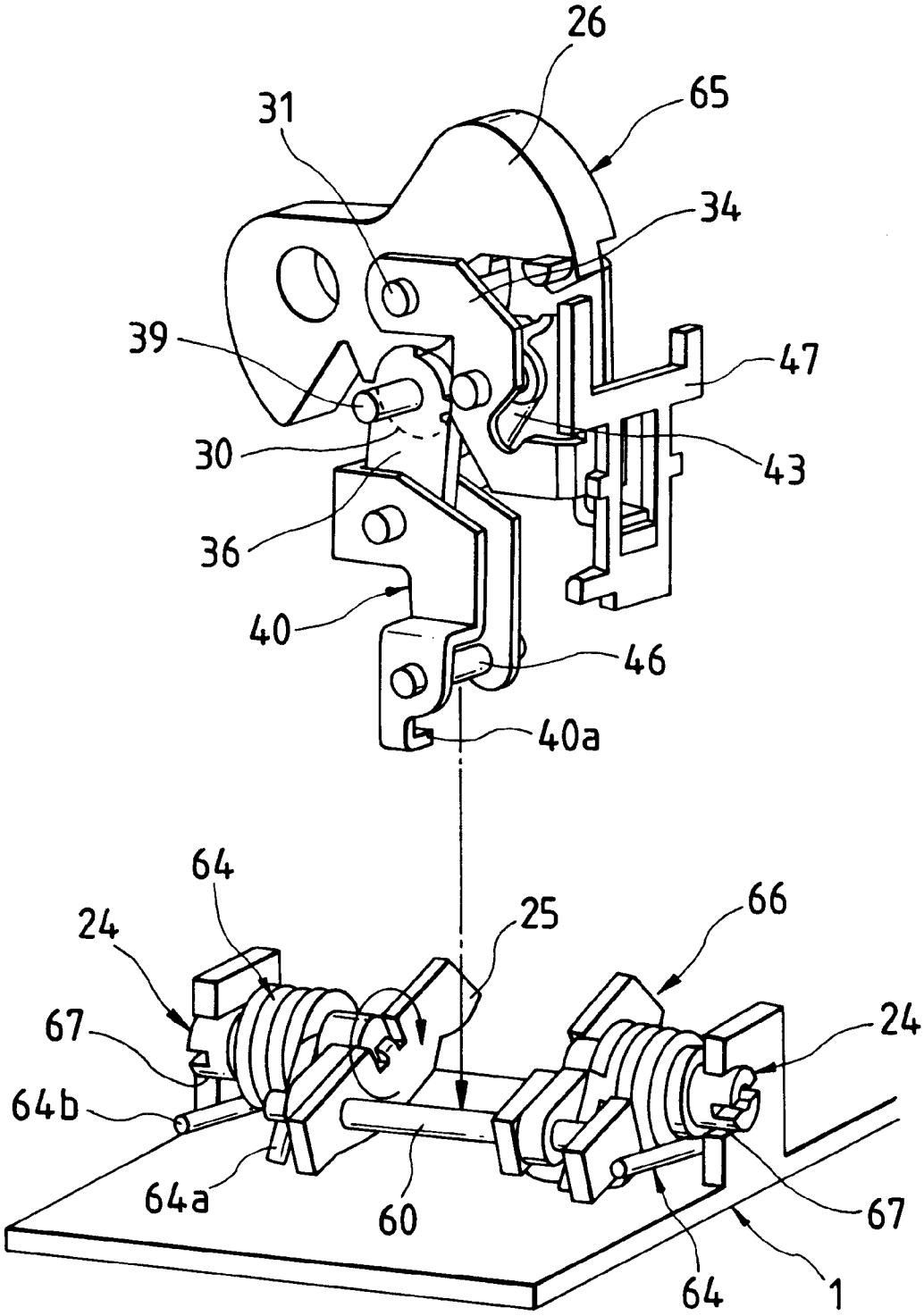
FIG. 1 is a perspective drawing that shows the operating part and the on-off switch part of the on-off switch mechanism to express the embodiment of the invention separately.
Figure 2:
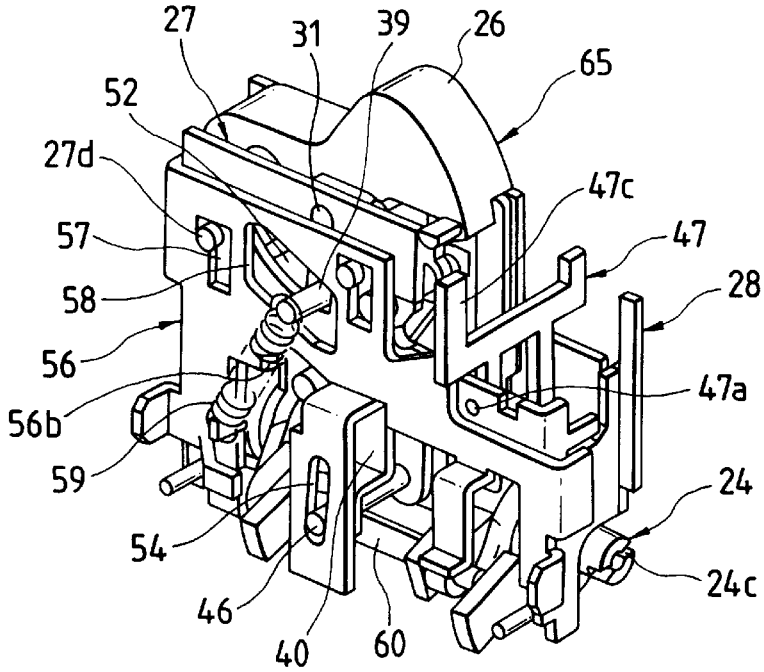
FIG. 2 is an entire perspective drawing of the on-off switch mechanism in FIG. 1.
Figure 3:
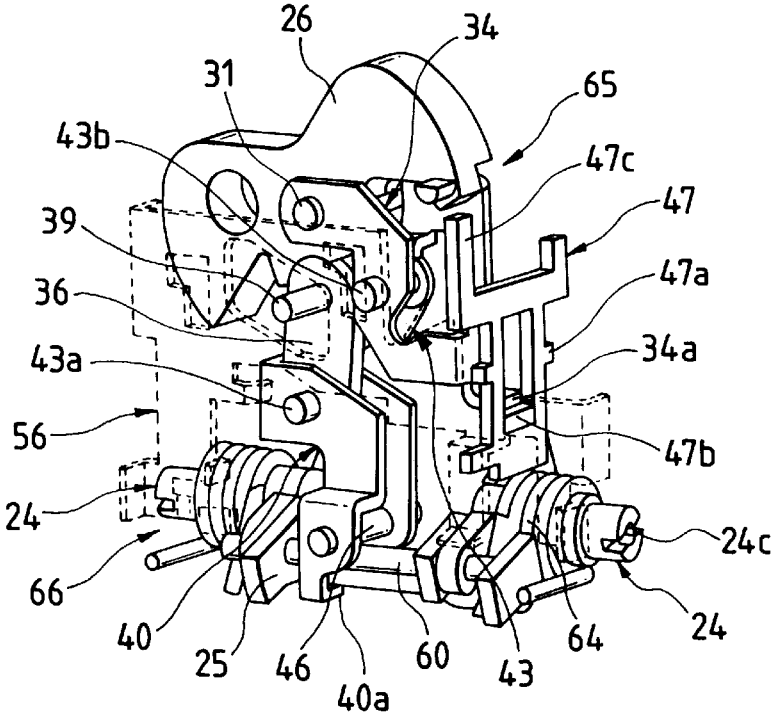
FIG. 3 is a perspective drawing that excludes the cover plate and the back plate from FIG. 2.
Figure 4:
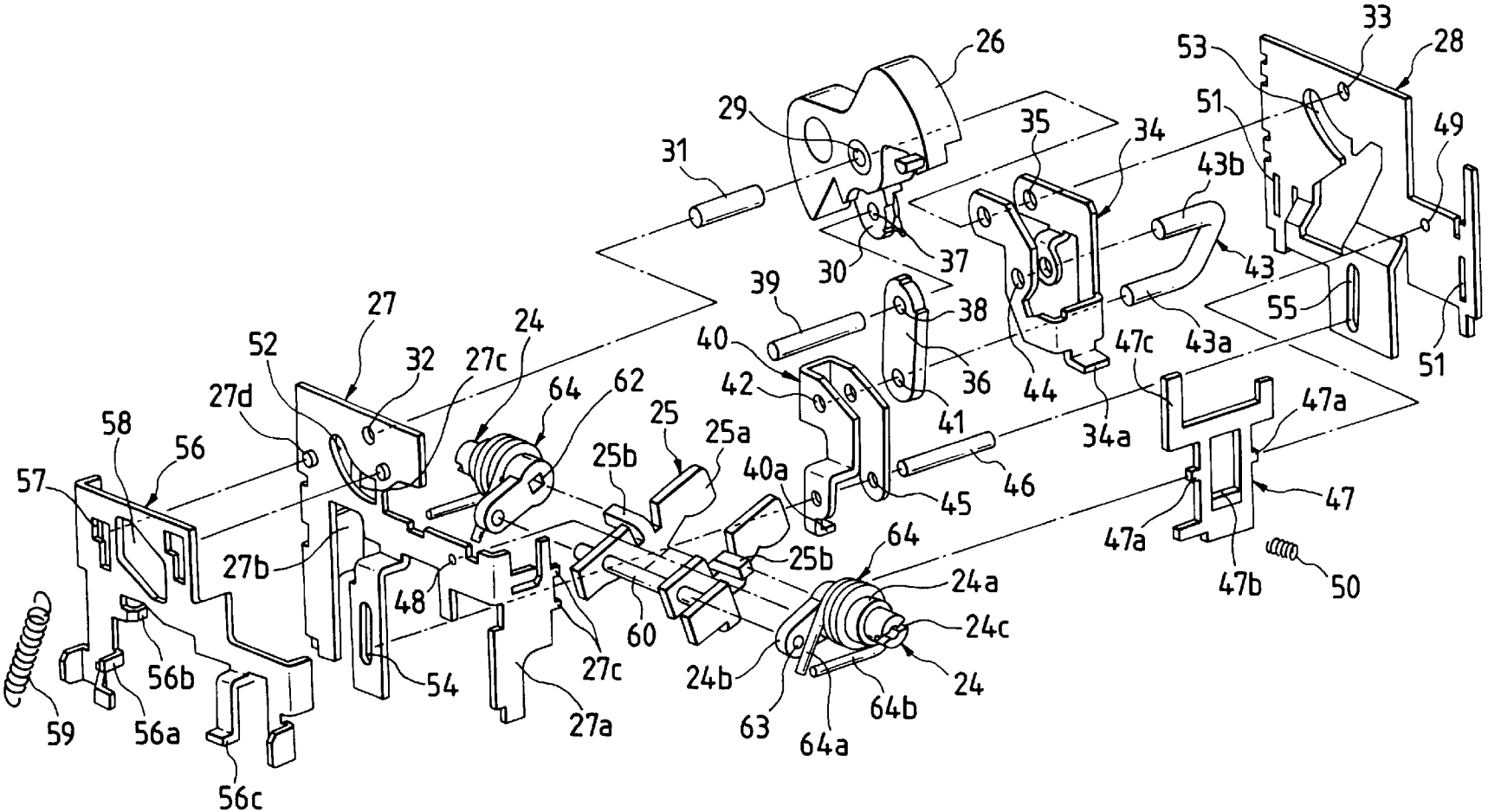
FIG. 4 is a disassembled perspective drawing of the on-off switch mechanism in FIG. 1.

FIGS. 1–4 are perspective drawing to show the structure of the on-off switch mechanism 23; FIG. 1 shows the operating part and the on-off switch part that are disengaged from each other; FIG. 2 shows the entire view of the on-off switch mechanism, FIG. 3 is a view in FIG. 2 but without a cover plate and a back plate; and FIG. 4 is an entire view of the disassembled on-off switch mechanism. As shown in FIGS. 1–4, especially in FIG. 4, the on-off switch mechanism 23 includes the cover plate 27 and the back plate 28, which support the operating part that is described hereafter. The operating handle 26 has a shaft-bearing hole 29 at the center thereof and a link lever 30 that extends downward is formed as a single piece at a position somewhat close to one side. The operating handle 26 is so supported by the cover plate 27 and the back plate 28 as to be capable of rotation, via a handle shaft 31 that is inserted into the shaft bearing hole 29 and both ends thereof are inserted into holes 32 and 33. In this state, the handle shaft 31 is also inserted into a hole 35 in a latch 34, and the latch 34 is thus so supported via the handle shaft 31 as to be capable of rotation.

One end of a link 36 is so engaged with the link lever 30 of the operating handle 26 as to be capable of rotation via a pin 39 that is inserted into respective holes 37 and 38. The link lever 30 and the link 36 constitute a booster. The other end of the link 36 is so engaged with the transmission plate 40 as to allow rotation via a U pin 43, one end 43*a* of which is inserted into respective holes 41 and 42. The other end 43*b* of the U pin 43 is inserted into a hole 44 of the latch 34, and the latch 34 and the link 36 are engaged with the U pin 43. A transmission shaft 46 is attached to the transmission plate 40 via a hole 45. One leg of the bifid transmission plate 40 shown in the figure is bent at a free end to form a hook part 40*a*.

A latch retainer 47 is so supported as to be capable of rotation by protruding shafts 47*a* on the both sides, which fit in holes 48 and 49 respectively in the cover plate 27 and the back plate 28. A reset spring 50 that comprises a compression spring is inserted between the lower end part of the latch retainer 47 and a bent part 27*a* of the cover plate 27. An engagement part 47*b* is formed on the lower rim of a square hole in the latch retainer 47, and a pawl 34*a* that is formed by bending the latch 34 is locked by this part. The cover part 27 and the back plate 28 for supporting the aforenamed parts are combined into a single unit when pairs of upper and lower projections 27*c* that are formed on the right and left bent parts 27*a* and 27*b* of the cover plate 27 are inserted into right and left slots 51 that are so formed in the back plate 28 as to match the projections 27*c* and riveted at the tips thereof.

Arc-shaped slots 52 and 53 are formed in the cover plate 27 and the back plate 28 along the locus of a pin 39 at the tip of the link lever 30 when the operating handle 26 rotates with the handle shaft 31 as the fulcrum, and both ends of the pin 39 are inserted loosely into them. Slightly-inclined upright slots 54 and 55 are respectively provided in the cover plate 27 and the back plate 28, and both ends of the transmission shaft 46 are so inserted into them as to slide freely.

An alarm output plate 56 covers the outside of the cover plate 27 and is suspended and supported by a pair of right and left cylindrical projections 27*d*, which are fitted in a pair of right and left holes 57 of a mirrored-L-shape, of the cover plate 27. A parallelogram window hole 58 is formed in the alarm output plate 56 while a spring holder 56*a* is formed by bending so that a trip spring 59 that comprises a tension coil spring is suspended between an end part of the pin 39 that protrudes through the window hole 58 and the spring holder 56*a*, and the alarm output plate 56 is applied with upward force in the ON state. A bumper piece 56*a* is formed by bending the alarm output plate 56, and the end part 43*a* of the U pin 43 confronts the bumper piece 56*b* in the ON state.

The on-off switch lever 25 that comprises a pair of right and left lever arms 25*a* that are engaged with each other comprises projections 25*b* that extend to the right and left. An interlock shaft 60 is attached to a rear end part of the lever of the right and left on-off switch shafts 24, which comprise stepped shaft parts 24*a* and the end parts thereof as arm parts 24*b*, windows 62 that correspond with the projections 25*b* of the on-off switch lever 25 are formed at the inner end centers, and holes 63 are formed at free ends of the arm parts 24*b*. Furthermore, transmission grooves 24*c* are formed in the diametric direction on the outer end parts of the shaft parts 24*a*. As shown in the figure, main springs 64 that comprise torsion springs are mounted on outer ends of large diameter parts 24*a*. The on-off switch shafts 24 are attached to the on-off switch lever 25 by fitting the holes 62 and the projections 25*b*, and the interlock shaft 60 is inserted to the holes 63 of the on-off switch shaft to refrain from the rotation. One end 64*a* of the main spring 64 is fastened to the interlock shaft 60.

In the above-described on-off switch mechanism 23, as shown in FIG. 1, the mechanism members, such as the operating handle 26, link lever 30, latch 34, link 36 and transmission plate 40, which are mutually engaged with the handle shaft 31, the pin 39 and U pin, constitute a single unit (operating part) 65. The on-off switch shafts 24, the main springs 64 and the on-off switch lever 25, which are mutually combined into a single body, constitute another unit (on-off switch part) 66. As shown in FIG. 2, the operating part 65 is supported by a frame that comprises the cover plate 27 and the back plate 28 via the handle shaft 31, and the frame is fastened to the casing 1 (FIG. 6) by fitting. As shown in FIG. 1, a U-shaped shaft-bearing groove 67 that is so formed in the casing 1 (FIG. 1 shows only a part of the casing 1) as to open to the power supply side supports the on-off switch part 66 via a small diameter part of the on-off switch shaft 24 in such manner as to allow free rotations. In this state, the other end 64*b* of the main spring 64, of which one end 64*a* is fastened to the interlock shaft 60, is fastened to the casing 1 so that the on-off switch lever 25 is applied with force in the direction of a solid line in FIG. 1.

In case where the operating part 65 and the on-off switch part 66 are assembled in the casing 1 as described above, the transmission shaft 46 is disposed orthogonally against the interlock shaft 60, as indicated by a chain-lined-arrow in FIG. 1, and, especially in the ON state shown in the figure, the interlock shaft 60 is pressed down against the main spring 64. FIG. 2 shows the entire on-off switch mechanism 23 in such ON state as above and FIG. 3 shows the operating part 65 and the on-off switch part 66 in the same ON state selectively.

FIGS. 5A–5C includes lateral side views of essential parts to show the actions of the on-off switch mechanism 23, FIG. 5A in the ON state, FIG. 5B in the OFF state and FIG. 5C in the trip state. In FIG. 5A, the transmission shaft 46 of which actions are limited inside the slots 54 and 55 of the cover plate 27 and the back plate 28 (FIG. 4) presses down the interlock shaft 60 and the on-off switch lever 25 is at the position in FIG. 6 after counterclockwise rotation with the on-off switch shaft 24 as the center. Therefore, in FIG. 6, the movable contact element 4 is pressed against the stationary contact elements 2 and 3 by the contact spring 5, and the electric circuit is closed for that while. At the time, the main spring 64 accumulates force from torsional deformation and applies force in clockwise direction in FIG. 6 to the on-off switch lever 25 and also in upward direction in FIG. 5A to the transmission shaft 46 via the interlock shaft 60.

In FIG. 5A, since the axial line that connects the pin 39 and the end part 43*a* of the U pin 43 passes the right-hand side of the handle shaft 31, the link 36 that receives force from the main spring 64 via the transmission plate 40 works to rotate the operating handle 26 counterclockwise and the pin 39 hits at the right-hand side end surfaces of the slots 52 and 53 of the cover plate 27 and the back plate 28 in FIG. 4. (see FIG. 2), so that the angle to the link lever 30, which constitutes the booster, is maintained approximately at 240 degrees as shown in the figure. In this state, the link 36 receives clockwise force with the pin 39 at the center and works to pull the latch 34 via the U pin 43. Consequently, although the latch 34 is applied with force rotating clockwise with the handle shaft 31 as the center, the pawl 34*a* is locked by the latch retainer 47 and maintained at the angle as shown in the figure.

When the operating handle 26 is operated to rotate clockwise from the ON position in FIG. 5A, at the time that the pin 39 passes the axial line that connects the handle shaft 31 and the end part 43*a* of the U pin 43 from the right-hand side to the left-hand side, action of the main spring 64 against the operating handle 26 is reversed, and thus the operating handle 26 come to receive clockwise force from the main spring 64. For this reason, the link lever 30 and the link 36 are rotated to form an angle of approximately 120 degrees and to ascend the end part 43*a* of the U pin 43, with the transmission shaft 46 ascending along the slots 54 and 55 to reach the OFF state in FIG. 5B. Consequently, the on-off switch lever 25 is released from the transmission shaft 46 and driven to rotate clockwise fast in FIG. 6 with energy discharged from the main spring 64, disconnecting the movable contact element 4 via the holder 20 and opening the electric circuit between the stationary contact elements 2 and 3. In FIG. 5B, the pin 39 hits at the end surface on the left side of the slots 52 and 53 (FIG. 4) and the operating handle 26 is maintained in the OFF position as shown in the figure.

When the operating handle 26 is operated to rotate counterclockwise in the OFF state in FIG. 5B, the U pin 43 is rotated counterclockwise with the end part 43*b* as the center of rotation, and, the link lever 30, the link 36 and the transmission plate 40 being interlocked, the transmission shaft 46 descends along the slots 54 and 55. This makes the on-off switch lever 25 rotate counterclockwise with torsional deformation of the main spring 64 as shown in FIG. 6. The main spring 64 so act as to push back the operating handle 26 until the reversal position where the handle shaft 31, the pin 39 and the end part 43*a* of the U pin 43 are aligned on a straight line is reached, and then, beyond the reversal position, the axial line that connects the pin 39 and the end part 43*a* of the U pin 43 comes to pass the right-hand side of the handle shaft 31 and settled in the ON state in FIG. 5A. In this course of time, as shown in FIG. 6, the movable contact element 4 ascends by receiving force from the contact spring 5 and closes the electric circuit, being pressed by the stationary contact elements 2 and 3. The rotational movements of the on-off switch shaft 24 at the above-described ON-OFF actions are transmitted as mechanical signals to the unshown outer packaging accessories that are engaged with the transmission groove 24*c* on the end surface via a rib.

FIG. 5C shows the trip state. In FIG. 6, when the bimetal 11 of the overloaded current detection device 9 warps after flow of overloaded current for a certain period of time, or when the plunger 17 of the electromagnetic device is attracted in an instant with such a large current as short-circuit current, an operating end part 47*c* of the latch retainer 47 is pushed to the left-hand side in FIG. 5A and the latch retainer 47 rotates counterclockwise with the protruding shafts 47*a* as the center. This unlocks the locking of the latch 34 by the latch retainer 47, as shown in FIG. 5C and rotates clockwise with the handle shaft 31 as the center.

As the consequence, when the end part 43*a* moves to the left while the U pin 43 rotates clockwise with the end parts 43*b* as the center, the transmission shaft 46 ascends along the slots 54 and 55. Accordingly, the interlock shaft 60 is released from the transmission shaft 46, and the on-off switch lever 25 is driven clockwise in FIG. 6 by the main spring 64 to disconnect the movable contact element 4 to open the circuit, and opening the electric circuit between the stationary contact elements 2 and 3. (trip action). In the circuit breaker in FIG. 6, when the plunger 17 is attracted by flow of a large current, the movable contact element 4 is driven to disconnect via the rammer 19 in advance of the above-described trip action of the on-off switch mechanism, but the description is eliminated here since this is not directly related to the invention.

On the other hand, although the operating handle 26 is applied with force diagonally downward in FIG. 5A from the trip spring 59 (see FIG. 2) via the pin 39 in the ON state in FIG. 5A, when the latch 47 is unlocked, the latch 47 is rotated to the position in FIG. 5C where the action line of the trip spring 59 passes the handle shaft 31 and stopped in an almost horizontal trip state as shown. In case the end part 43*a* of the U pin 43 moves to the left on reception of the force from the main spring 64 when the above-described trip action occurs in the ON state in FIG. 5A, the end part 43*a* hits at the bumper piece 56*b* (see FIG. 4) of the alarm output plate 56 that is shown in dashed lines in FIGS. 5A to 5C and horizontally moves the alarm output plate 56 to the left in FIG. 5A. This disengages the engagement of the shoulder part of the mirrored L-shape hole 57 and the projection 27*a* on the cover plate 27, and the alarm output plate 56 is lifted until the bottom end surface of the mirrored L-shape hole 57 hits at the projection 27*a* by the spring force of the trip spring 59. The alarm output plate 56 performs the on-off switching operation of the unshown alarm contacts via the output projection part 56*c* (FIG. 4) and transmits the trip signals to the outside.

At the time of above-described trip actions, in case where fusing has occurred between the movable and immovable contacts, the movable contact element 4 is locked in a closed-circuit state, and thus the on-off switch lever 25 cannot rotate and remains in the ON state in FIG. 5A, but, the operating handle 26 that receives the force from the trip spring 59 tends to transfer to FIG. 5C state on unlocking of the latch 34. It is inconvenient, however, that the operating handle 26 shows indication of trip in spite that the movable contact element 4 is locked. Thus, at the tip of the transmission plate 40, a hook part 40*a* is formed. That is, the hook part 40*a* comes to engage with the interlock shaft 60 of the on-off switch lever 25 when the rotation of the on-off switch lever 25 is disabled by locking of the movable contact element 4 by fusion at the contact, and thus rotation of the operating handle 26 from the ON position to the trip position is prevented. This enables unification of the state of actions at the operating part 65 and the on-off switch part 66 at the time of abnormality, such as contact fusion.

The on-off switch mechanism 23 described above has the structure wherein the operating part 65 that comprises such mechanism members as the operating handle 26, the link lever 30, the link 36 and the transmission plate 40 and the on-off switch part 66 that comprises on-off switch 24, the main spring 64 and the on-off switch lever 25 are separate unit and the operating part 65 and the on-off switch part 66 are so engaged as to be disengaged and re-engaged freely via the transmission shaft 46 and the interlock shaft 60 which are disposed orthogonally. In this case, since the operating part 65 that is not related to the rated current and case dimensions may be used in common, whereas the on-off switch part 66 includes the main spring 64 that requires specifications varied by the rated current and the on-off switch lever 25 that requires varied width according to the case dimensions, on-off switch mechanisms of various specifications are available from free combinations of the operating parts 65 and the on-off switch parts 66 and thus there will be no need to have a large stock of on-off switch mechanisms fully assembled in advance.

Additionally, since the hook part 40*a* that is provided at the tip of the transmission plate 40 that is attached with a transmission shaft 46, the hook part 40*a* can engage with the interlock shaft 60 of the on-off switch lever 25 so that the actions of the operating part 65 can be unified with those of the on-off switch part 66 in a case where rotation of the on-off switch lever 25 is disabled by the movable contact element that is locked by such a cause as fusing of the contact point.

Moreover, since the pair of on-off switch shafts 24 on the right and left are fitted onto the projections 25*b* that are provided on both sides of the on-off switch lever 25, a larger space is reserved inside of the lever arm 25*a* of the on-off switch lever 25, and this facilitates parts layout inside the casing 1. Furthermore, since the transmission grooves 24*c* for transmission of mechanical signals to outer packaging accessories are disposed in a diametric direction on the end surfaces of the on-off switch shaft 24, the mechanical action signals can be transmitted with ease to the outer packaging accessories that are disposed on the lateral side of casing 1. Although the embodiment in the drawings is provided with one groove 24*c* on each end surface, two or more of the transmission grooves may be provided in different directions on a selfsame end surface.

As described above, according to the invention, the operating part that has no relevance to the rated current or casing dimensions and the on-off switch part that includes the on-off switch lever with a width that is varied by the casing dimensions and the main spring of which specifications are varied by the rated current are structured as the separate units, and the operating part and the on-off switch part are so structured as to be engaged and disengaged freely to constitute the on-off switch mechanisms to conform with various specifications through combination of the common-use operating part and the specification-conforming on-off switch part so that variations of the assembled on-off switch mechanisms can be limited and the assembling operations and parts control can be simplified.

What is claimed is:

1. A circuit breaker on-off switch mechanism comprising:

an operating part comprising an operating handle, a handle shaft, and a mechanism member, the operating handle engaging the handle shaft and being rotatable with the handle shaft as a fulcrum, the mechanism member being interconnected to the operating handle within the operating part to move responsive to rotation of the operating handle; and an on-off switch part comprising an on-off switch lever, an on-off switch shaft, and a main spring, the on-off switch lever is supported for rotation by the on-off switch shaft between a circuit on position and a circuit off position, the main spring biases the on-off switch lever to rotate from one of the on and off positions to the other of the on and off positions;

the mechanism member has a portion engagable with a portion of the on-off switch lever to control movement of the on-off switch lever responsive to rotation of the operating handle, the portion of the mechanism member and the portion of the on-off switch lever being configured to permit assembly of the on-off switch part separate from the assembly of the operating part and engagement of the portions of the mechanism member and the on-off switch lever subsequent to assembly of the on-off switch part.

2. The circuit breaker on-off switch mechanism as set forth in claim 1, wherein the operating part is operationally supported on a fixed support structure and the on-off switch part is operationally supported on another fixed support structure.

3. The circuit breaker on-off switch mechanism as set forth in claim 2, wherein the support structure for the operating part is in turn supported by the support structure supporting the on-off switch part.

4. The circuit breaker on-off switch mechanism as set forth in claim 1, wherein a rotational axis of the operating handle is transverse to a rotational axis of the on-off switch lever.

5. The circuit breaker on-off switch mechanism as set forth in claim 1, wherein the mechanism member includes a link connected to the operating handle by a rotational pin, and a transmission plate connected to the link by a pin, the link can move relative to the operating handle and the transmission plate can move relative to the link, the portion of the mechanism member engagable with the portion of the on-off switch lever is located on the transmission plate.

6. The circuit breaker on-off switch mechanism as set forth in claim 5, wherein the portion of the mechanism member includes a transmission shaft and a hook of the transmission plate, the transmission shaft is located on one side of the portion of the on-off switch lever and the hook is located on another side of the portion of the on-off switch, and the portion of the mechanism member is located relative to the portion of the on-off switch lever without disassembly of the on-off switch part.

7. The circuit breaker on-off switch mechanism as set forth in claim 1, including a movable contact element and at least one fixed contact element, the on-off switch lever moving the movable contact element into engagement with the fixed contact element upon rotation to the circuit on position.

8. The circuit breaker on-off switch mechanism as set forth in claim 1, wherein the portion of the mechanism member includes a longitudinally extending transmission shaft and the portion of the on-off switch lever includes a longitudinally extending interlock shaft, the transmission shaft extends orthogonally to the extent of the interlock shaft.

9. The circuit breaker on-off switch mechanism as set forth in claim 8, wherein the portion of the mechanism member includes a hook, the hook extends to engage a side of the interlock shaft opposite to an engagement of the transmission shaft to the interlock shaft.

10. The circuit breaker on-off switch mechanism as set forth in claim 1, wherein the on-off switch shaft is a portion of a pair of on-off switch shafts of the on-off switch part, each of the on-off switch shafts is located on a respective side of the on-off switch lever, and the on-off switch lever has portions that fittingly engage the on-off switch shafts.

11. The circuit breaker on-off switch mechanism as set forth in claim 1, wherein the on-off switch shaft has a transmission groove for engagement with a component to indicate rotation of the on-off switch shaft.

12. A circuit breaker on-off switch mechanism comprising:

an operating part comprising an operating handle, a handle shaft, and a mechanism member, the operating handle engaging the handle shaft and being rotatable with the handle shaft as a fulcrum, the mechanism member being interconnected to the operating handle within the operating part to move responsive to rotation of the operating member; and an on-off switch part comprising an on-off switch lever, an on-off switch shaft, and a main spring, the on-off switch lever is supported for rotation by the on-off switch shaft between a circuit on position and a circuit off position, the main spring biases the on-off switch lever to rotate from one of the on and off positions to the other of the on and off positions;

the operating part being configured to interact with the on-off switch part at a single interaction location which includes a portion of the mechanism member that is engagable with a portion of the on-off switch lever to control movement of the on-off switch lever responsive to rotation of the operating handle.

13. The circuit breaker on-off switch mechanism as set forth in claim 12, wherein the operating part is operationally supported on a fixed support structure and the on-off switch part is operationally supported on another fixed support structure.

14. The circuit breaker on-off switch mechanism as set forth in claim 13, wherein the support structure for the operating part is in turn supported by the support structure supporting the on-off switch part.

15. The circuit breaker on-off switch mechanism as set forth in claim 12, wherein a rotational axis of the operating handle is transverse to a rotational axis of the on-off switch lever.

16. The circuit breaker on-off switch mechanism as set forth in claim 12, wherein the mechanism member includes a link connected to the operating handle by a rotational pin, and a transmission plate connected to the link by a pin, the link can move relative to the operating handle and the transmission plate can move relative to the link, the portion of the mechanism member engagable with the portion of the on-off switch lever is located on the transmission plate.

17. The circuit breaker on-off switch mechanism as set forth in claim 16, wherein the portion of the mechanism member includes a transmission shaft and a hook of the transmission plate, the transmission shaft is located on one side of the portion of the on-off switch lever and the hook is located on another side of the portion of the on-off switch, and the portion of the mechanism member is located relative to the portion of the on-off switch lever without disassembly of the on-off switch part.

18. The circuit breaker on-off switch mechanism as set forth in claim 12, wherein the portion of the mechanism member includes a longitudinally extending transmission shaft and the portion of the on-off switch lever includes a longitudinally extending interlock shaft, the transmission shaft extends orthogonally to the extent of the interlock shaft.

19. The circuit breaker on-off switch mechanism as set forth in claim 12, wherein the on-off switch shaft is a portion of a pair of on-off switch shafts of the on-off switch part, each of the on-off switch shafts is located on a respective side of the on-off switch lever, and the on-off switch lever has portions that fittingly engage the on-off switch shafts.

20. The circuit breaker on-off switch mechanism as set forth in claim 12, wherein the on-off switch shaft has a transmission groove for engagement with a component to indicate rotation of the on-off switch shaft.

* * * * *

UNITED STATES PATENT AND TRADEMARK OFFICE

CERTIFICATE OF CORRECTION

PATENT NO. : 6,486,417 B1 
DATED : November 26, 2002
INVENTOR(S) : Kentaro Toyama et al.

It is certified that error appears in the above-identified patent and that said Letters Patent is hereby corrected as shown below:

Column 1,
Line 16, please delete “anon-off”, and insert therefor -- an on-off --.

Column 5,
Line 25, after “lever”, please insert therefor -- arm 25*a* in such manner as to penetrate the between. In a pair --.

Signed and Sealed this

Tenth Day of June, 2003

JAMES E. ROGAN
*Director of the United States Patent and Trademark Office*